United States Patent [19]

Jacobs

[11] Patent Number: 5,049,289

[45] Date of Patent: Sep. 17, 1991

[54] GRAPHITE-CONTAINING LUBRICANT COMPOSITION

[76] Inventor: Norman L. Jacobs, 4/24 Blaxland Road Bellevue Hill, Sydney N.S.W. 2023, Australia

[21] Appl. No.: 418,024

[22] Filed: Oct. 10, 1989

[51] Int. Cl.[5] ..... C10M 125/02

[52] U.S. Cl. ..... 252/22; 252/29

[58] Field of Search ..... 252/29, 22

[56] References Cited

U.S. PATENT DOCUMENTS

| | | | |
|---|---|---|---|
| 300,024 | 6/1884 | Smalles | 253/29 |
| 1,304,477 | 5/1919 | Guas | 252/29 |
| 1,395,073 | 10/1921 | Willes | 252/30 |
| 2,176,879 | 10/1939 | Bartell | 252/29 |
| 3,089,849 | 5/1963 | Linson | 252/29 |
| 4,372,861 | 2/1983 | Chao | 252/29 |
| 4,713,186 | 12/1987 | Kristen et al. | 252/29 |

*Primary Examiner*—Jacqueline V. Howard

*Attorney, Agent, or Firm*—Armstrong, Nikaido, Marmelstein, Kubovcik, & Murray

[57] ABSTRACT

A lubricant composition for use in threaded tube and pipe connections comprises from 10 to 70% by weight of pure, crystalline, graphite and from 0.1% to 10% by weight (calculated of graphite) of a special additive in the form of strongly polarizable or ionizable organic compounds like e.g. amines, amine salts, metal-amine complexes, combinations of amines with polymers, polymeric amines, ammonium compounds, alkylsulphates, organic phosphates, phosphonates and sulphonates. The balance is formed by a supporting vehicle such as an oil or grease. In this composition, the performance characteristics of the graphite have been improved by the special edditive such that it can be used for lubricating and sealing threaded tube and pipe connections under conditions of extreme pressure.

26 Claims, No Drawings

GRAPHITE-CONTAINING LUBRICANT COMPOSITION

This invention relates to lubricant compositions containing substantial proportions of graphite. More in particular, it relates to graphite-containing lubricant compositions which can be used with advantage for the lubrication and sealing of threaded tube and pipe connections under conditions of extreme pressure.

Lubricant compositions are materials that can be introduced between opposed solid surfaces, e.g. surfaces of machine parts, in order to prevent these surfaces from contacting each other and to facilitate any relative motion between them. As a consequence, such lubricant compositions must have hydrodynamic properties that is the capacity of building up an internal pressure which is sufficient to balance the load on the opposed surfaces, and further friction-reducing and wear-reducing properties.

Many lubricant compositions have the form of oils and greases and can be used for a wide variety of applications. Lubricant oils may be based on petroleum derivatives, animal or vegetable oils or on synthetic materials such as polyalkylene glycols dibasic acid esters, phosphate esters, silicones, silicate esters and the like. Lubricant greases are combinations of such oils with thickening agents like e.g. metal soaps, modified clays, fine silicas, and/or fillers like e.g. asbestos, graphite, metal oxides, metal powders, metal sulphides and the like. Moreover, lubricant oils and greases may contain special additives, e.g. to resist oxidation and corrosion and to improve film strength.

Other lubricant compositions have particulate solids as an essential ingredient and can be used in cases where the opposed surfaces are subjected to high pressure and work loads during use. Such particular solid lubricants may consist of inorganic compounds having laminar crystal lattices such as crystalline graphite, molybdenum disulphide and the like, other soft inorganic compounds such as lead oxide, lime, talc, bentonite and the like, soft organic compounds such as soaps, waxes and fats, soft polymers such as polytetrafluoroethylene or polychlorofluoroethylene and the like, or malleable metals such as lead, copper, aluminum and the like. All these solid lubricants have in common that they are plastic, elastic, malleable or fracturable and that they are generally soft in the particular sense of having rather low yield limits to their mechanical properties, or in any case, yield limits which are lower than the forces due to pressure or work load exerted upon them during use. The particulate solid lubricants may be used as such or as dispersions in oils, greases or even water-based vehicles.

In the oil and gas production industry, special types of lubricant compositions are used for application between the male and female parts of threaded tube or pipe connections in order to prevent these parts from being welded together and also to provide a fluid tight seal between them during use. Such lubricant compositions (often termed "thread compounds") should permit the threaded connections to be made up and loosened several times during the construction of oil and gas wells despite the high work loads exerted on them. Moreover, after make-up of the threaded connections, the lubricant compositions should be capable of providing a fluid tight seal between the threaded parts, even if an oil or gas is flowing at high pressure through the tubing or pipe carrying such connections. Only a few types of lubricant composition will be able to satisfy these requirements.

A particular type of lubricant composition especially designed for use in threaded connections is the API Modified Thread Compound as proposed by the American Petroleum Institute in its bulletin 5A2. This API Modified Thread Compound will contain 30.5 weight % of particulate lead, 12.2 weight % of particulate zinc, 3.3 weight % of flaked copper and a minor proportion of graphite in a petroleum-based grease. Such composition satisfies the above mentioned requirements and has high performance characteristics due to the high proportion of malleable metal particles in it. Thus, if the composition is applied between the male and female parts of a threaded tube or pipe connection and if these parts are screwed together, the composition will be subjected to increasing pressures within the reducing spaces between the threaded parts. The metal particles and in particular the lead particles in the composition will be deformed then into flakes of various sizes and shapes, thanks to the malleability and plasticity of the metal constituting these particles. The general shape of the flakes tends to become elongated in the direction of movement of the threaded parts, that is in the radial direction thereof. Sometimes, flakes are found having a length of 5 mm or more. Under these conditions, the lead flakes will serve to keep the threaded parts apart at their adjacent surfaces, and also to provide a seal between those parts in order to prevent any fluid within the threaded pipe or tube connection to escape to the outside. The zinc and copper particles in the API Modified Thread Compound will modify the functional characteristics of the lead particles to a desired extent.

Yet, inspite of the high performance characteristics of the API Modified Thread Compound, it has some important disadvantages. One disadvantage is that such Thread Compound is unable to protect the threaded connections sufficiently against corrosion and rusting during storage, just because of the presence of the metallic components in that composition. Another disadvantage is that the metal particles in the Thread Compound are toxic to the environment and will contribute heavily to the pollution of surface waters on land and sea during use. Further disadvantages are that the API Modified Thread Compound provides insufficient sealing in couplings provided with an O-ring and that it is incompatible with threaded connections of fiberglass.

An object of the invention is to provide a lubricant composition which can be used instead of the API Modified Thread Compound for lubricating and sealing threaded pipe or tube connections and which has similar or even better performance characteristics. Another object is to provide a lubricant composition which can be used with advantage in threaded pipe or tube connections and which will protect such connections against corrosion and rusting during storage. Still another object is to provide a lubricant composition for use in threaded pipe or tube connections which will contribute less than the known compositions to the problem of pollution of surface waters. Further objects are to provide a lubricant composition which permits better sealing of couplings provided with an O-ring and which is compatible with threaded connections of fiberglass.

The lubricant composition of the present invention makes use of pure crystalline graphite instead of lead particles as an essential ingredient of the composition.

Since, however, the performance characteristics of crystalline graphite alone are insufficient, a special additive in the form of a strongly polarisable or ionisable organic substance is added thereto.

If crystalline graphite alone is subjected to compaction due to lubrication under extreme pressure, the material will form flakes in a similar fashion as metallic lead particles. Nevertheless, most of the graphite flakes will be substantially smaller in size than the lead flakes and normally do not measure more than 0.5 mm at their greatest dimension. Further, the flakes appear to have insufficient strength to withstand the forces that would usually be exerted upon them so that they fracture and break up. The graphite then returns to various particulate forms of small dimensions and even becomes eliminated to a considerable extent from its location between the threaded parts. Therefore, crystalline graphite by itself is not very effective as an extreme pressure agent in lubricant compositions, even when used in large quantities.

U.S. Pat. No. 2,419,144 to John P. Kelly discloses a lubricant composition for use between close fitting metal surfaces to effect a gas tight sealing of the joint therebetween and to prevent seizing of the contacting surfaces. This composition comprises 19–27% graphite, 11–25% of talc and 9–15% of lithium or barium stearate in 34–44% petroleum-based lubricating oil. However, it has appeared in practice that the lubricating and extreme pressure characteristics of graphite are adversely affected by the presence of talc and mica. If graphite is contaminated by these substances, its flaking characteristics are modified to the extent that flakes produced under compaction are noticeably smaller than those composed of pure graphite. In comparative tests on the extreme pressure lubricating properties of several compositions, samples containing graphite and talc performed worse than those containing graphite free of talc.

In accordance with the present invention, it has now been found that the performance characteristics of crystalline graphite in a lubricant composition for threaded connections can be improved by using a special additive selected from strongly polarisable or even ionisable organic substances. In that case, compositions can be made which have similar performance characteristics as lead-containing lubricant compositions in threaded tube or pipe connections. Moreover, such compositions containing graphite and special additive will protect the threaded connections against corrosion and rusting during storage and will contribute less than the known compositions to the problem of pollution of surface waters or land and sea. They will also provide better sealing properties in O-ring couplings and will be compatible with threaded connections of fiberglass.

The invention will now be described in more detail.

An essential ingredient in the invented lubricant composition is crystalline graphite which has the property of forming flakes under conditions of extreme pressure. The graphite should have a purity of more than 80% in order to prevent any negative influence on the flaking properties by constituent impurities. Preferably, the graphite is of 90–99% purity and more preferably of 92–96% purity. It may be present in a proportion between 10 and 70 weight % preferably between 20 and 40 weight % and more preferably between 40 and 50 weight % of the lubricant composition in order to have advantage of its flaking characteristics, for lubrication and sealing under extreme pressure.

The special additive for improving the performance characteristics of graphite may comprise in general any strongly polarisable or ionisable organic compound. More in particular, it may comprise amines, amine salts, metal-amine complexes, combinations of amines with polymers, and polymeric amines. Suitable amines are aliphatic, aromatic and arylaliphatic mono-, di-, tri- or polyamines having primary, secondary and/or tertiary amine groups or even quaternary. ammonium groups. The number of carbon atoms in the hydrocarbon chains may vary widely between 1 and 30 or more although the material should not be volatile in order to remain in the composition as a stable component. The amines are preferably compatible with or soluble in the supporting vehicle of the composition which may be an oil or grease. A preferred material is formed by the so-called fatty amines which have been derived from naturally occurring fats and which primarily consist of a mixture of aliphatic mono or diamines. The amines may have been converted to their acid-addition salts by means of suitable organic or inorganic acids or converted to metal-amine complexes by means of metal oxides. Preferred materials are tallow diamine, tallow diamine salts, and distearyl dimethyl quaternary ammonium methyl-sulphate. The amines, amine salts and metal-amine complexes are used in proportions between 0.1% and 10% by weight and preferably in a proportion of about 1% by weight, based on graphite.

If a lubricant composition containing pure crystalline graphite and an amine, amine salt or metal-amine complex is subjected to compaction due to lubrication under extreme pressure and work load, the graphite crystals will be converted to flakes of relatively large size which are capable of keeping the lubricated parts apart and providing a seal between those parts. Thus, it seems that the amine, amine salt or metal-amine complex tends to promote flake formation and also to bring about an agglomeration of flakes. In any case, the graphite will have high performance characteristics under extreme pressure, comparable to those of lead particles and apparently due to the effect of the added amine, amine salt or metal-amine complex. Further, the composition can be used without problems in threaded connections of fiberglass tubing since it is compatible with fiberglass.

In some cases, the sealing effect provided by a lubricant composition comprising pure crystalline graphite and an added amine, amine salt or metal-amine complex will not be sufficient due to migration of graphite and amine from the lubricated parts under extreme pressure. In those cases, it may be advisable to add a polymeric material as a further ingredient to the composition, that is to use the crystalline graphite with a special additive comprising a combination of amine (or amine salt or metal-amine complex) and a polymer. Such polymeric material will reduce the migration of graphite and amines from the lubricated parts on compression and will further enhance the formation of flakes, even in very small proportions. It will impart elasticity to the composition and further improve its lubricity and sealing properties. If the lubricant composition contains such additive is used in threaded connections of fiberglass tubing having a low elasticity modulus, the composition is not only compatible with the fiberglass but it can also provide a superior lubricity and sealing there due to its high elasticity.

The polymeric material should preferably be compatible or soluble in the grease or other supporting vehicle of the composition and should possess useful adhesive and cohesive properties. Suitable polymers which fall in this category are atactic and isotactic polypropylenes, polyethylenes, polybutylenes, isopolybutylenes, rosin esters and derivatives, polymerized rosin ester derivatives, many hydrocarbon resins, many latexes and rubbers and the like. Among these materials, branched low molecular polyethylene and atactic polypropylene are preferred. Such polymeric materials may be used in proportions ranging from about 0.5% to about 60% by weight of the graphite present in the composition, with preferred proportions between 5 and 15% by weight. It should be noted that this polymeric material should always be used in combination with the above mentioned amines, amine salts or metal-amine complexes.

In some cases, materials combining the functions of amine and polymer may be used as an additive to crystalline graphite in the lubricant compositions of the invention. Such materials are e.g. polyalkylene oxide adducts of amines like tetrakis-hydroxypropylene diamine, which may be either soluble in water or oil and therefore offer formulating flexibility. Such polymeric amines may be used in proportions between 0.1% and 60% based on graphite.

In other cases, ammonium compounds such as e.g. ammonium salts of organic acids or ammonium complexes can be used instead of or in addition to amines. Their proportion may vary from about 0.5% and 60% based on graphite.

Instead of cationic substances like amines and the like, the special additive used in addition to crystalline graphite may also comprise anionic substances like e.g. alkylsulphates, organic phosphates, phosphonates and sulphonates. These substances can be used with the same advantages and in similar proportions as the aforesaid amines.

The invented lubricant composition will further comprise a supporting vehicle which may be an oil or grease or even a water based medium. This vehicle may contain thickening agents like e.g. metal soaps, modified clays or the above-mentioned polymeric amines; fillers like e.g. amorphous graphite, metal oxides, metal powders, metal sulphides and the like (with the exception of talc), and conventional additives such as e.g. anti-oxidation and anti-corrosion agents. Care should be taken, however, to prevent contamination of the graphite with talc or mica so that the graphite will not loose any appreciable degree of functionality.

A preferred composition for use in threaded connections may have the following ingredients:

30 weight % of pure crystalline graphite,
20 weight % of amorphous graphite (filler),
7.5% of isotactic polyethylene (based on crystalline graphite),
1.75% tallow diamine (based on crystalline graphite), and the balance a petroleum oil-based greased containing a metal soap (lithium 12-hydroxystearate) and an anti-corrosion agent (ZnO).

Another preferred composition for use in threaded connections comprises:

45 weight % of crystalline graphite (purity 92/96%)
5 weight % atactic polypropylene (based on total composition),
1 weight % tallow diamine (based on total composition),
1 weight % neodecanoic acid (based on total composition),
6 weight % calcium dodecylbenzene sulphonate,
3 weight % magnesium oxide, and the balance being a grease based on petroleum oils.

In another preferred composition, the ingredients were as stated above, but a mixture of biodegradable vegetable oils were substituted for the petroleum oils.

Other formulations are readily conceivable by those skilled in the art and these may include some formulations containing between 0.5% and 25% by weight of aluminium or copper flakes, or both, but preferably in proportions not greater than 10% lest contamination or dilution of the properties of the graphite should result. (Also, the presence of such materials may assist the forces of corrosion).

The invention will be illustrated by the following Example which gives the results of several experiments.

EXAMPLE

Lubricant compositions of different formulations were applied between the male and female parts of API 8 round threaded connections whereupon these connections were made up and loosened several times until seizure took place and the parts were torn apart. The compositions used (percentages of graphite, talc, tallow diamine and atactic polypropylene (APP) in the composition, with lithium based grease as a balance) as well as the test results (average number of times that the connections could be made up and loosened in each of four tests) are represented in the following table. It should be noted that tests 1-5 and 7-9 were conducted at the same time and that tests 6 and 10 were also conducted at the same time.

TABLE

| Test No. | Compositions | | | | Test Results |
|---|---|---|---|---|---|
| | Graphite | Talc | Tallow Diamine | APP. | |
| 1 | 30 | 15 | — | — | 5.50 |
| 2 | 30 | 15 | 0.5 | — | 6.75 |
| 3 | 30 | 15 | — | 0.5 | 5.50 |
| 4 | 30 | 15 | 0.5 | 0.5 | 7.25 |
| 5 | 30 | — | — | — | 6.25 |
| 6 | 45 | — | — | — | 7.25 |
| 7 | 30 | — | 0.5 | — | 12.50 |
| 8 | 30 | — | — | 0.5 | 6.25 |
| 9 | 30 | — | 0.5 | 0.5 | 14.25 |
| 10 | 42.5 | — | 2.5 | 5.0 | 17.00 |

It can be seen from the table that tallow diamine and combinations of tallow diamine and APP have a positive effect on the performance characteristics of graphite in the composition, whereas talc has a negative effect under all circumstances. Composition no. 9 was substantially equivalent in performance to API Modified Thread Compound and composition no. 10 showed even better performance.

What I claim is:

1. A lubricant composition for use in threaded connections, said composition comprising:

10 to 70% by weight of pure crystalline graphite,
0.1 to 10% by weight (calculated on graphite) of an ionizable or polarizable additive selected from the group consisting of amines, amine salts, metal-amine complexes, amine-containing polymers, alkyl sulphates, phosphonates and sulphonates, and the balance being a supporting vehicle.

2. The lubricant composition as claimed in claim 1, which comprises pure crystalline graphite in a proportion of 20-40% by weight.

3. The lubricant composition as claimed in claim 1, wherein said amine has been selected from the group consisting of aliphatic, aromatic, and aryl-aliphatic mono, di, tri and polyamines.

4. The lubricant composition as claimed in claim 1 wherein said amine is a fatty amine.

5. The lubricant composition as claimed in claim 1 wherein said supporting vehicle is a grease.

6. A lubricant composition for use in threaded connections, said composition comprising:

10 to 70% by weight of pure crystalline graphite, 0.1 to 10% by weight (calculated on graphite) of an ionizable or polarizable additive selected form the group consisting of amines, amine salts, and metal-amine complexes, 0.5–60% by weight (calculated on graphite) of a polymeric material, different from said additive and the balance being a supporting vehicle.

7. The lubricant composition as claimed in claim 6, wherein crystalline graphite is present in a proportion of 20–40% by weight.

8. The lubricant composition as claimed in claim 6, wherein said amine has been selected from the group consisting of aliphatic, aromatic and arylaliphatic mono, di, tri and polyamines.

9. The lubricant composition as claimed in claim 6, wherein said aliphatic amine is a fatty amine.

10. The lubricant composition as claimed in claim 6, wherein 5 to 15% by weight of polymeric material is present.

11. The lubricant composition as claimed in claim 6, wherein said polymeric material has been selected from the group consisting of atactic and isotactic polypropylenes, polyethylenes, polybutylenes, isopolybutylenes, rosin esters and derivatives, polymerized rosin ester derivatives, hydrocarbon resins, latexes and rubbers.

12. The lubricant composition as claimed in claim 6, wherein said supporting vehicle is a grease.

13. A lubricant composition for use in threaded connections, said composition comprising:

10–70% by weight of pure crystalline graphite, 0.1–60% percent by weight (calculated on graphite) of an ionizable or polarizable amine-containing polymer, and the balance being a supporting vehicle.

14. The lubricant composition as claimed in claim 13 wherein pure crystalline graphite is used in a proportion of 20–40% by weight.

15. The lubricant composition as claimed in claim 13, wherein said amine-containing polymer is a polyalkylene oxide adduct of an amine.

16. The lubricant composition as claimed in claim 13, wherein said amine-containing polymer is a polyalkylene oxide adduct of tetrakis-hydroxypropylene diamine.

17. The lubricant composition as claimed in claim 13, wherein said supporting vehicle is a grease.

18. A lubricant composition for use in threaded connections, said composition comprising:

10–70% by weight of pure crystalline graphite, 0.1–10% by weight (calculated on graphite) of an ionizable or polarizable additive selected from the group consisting of alkylsulphates, phosphonates and sulphonates, and the balance being a supporting vehicle.

19. The lubricant composition as claimed in claim 1 wherein said supporting vehicle is oil.

20. The lubricant composition as claimed in claim 6 wherein said supporting vehicle is oil.

21. The lubricant composition as claimed in claim 13 wherein said supporting vehicle is oil.

22. The lubricant composition as claimed in claim 18 wherein said supporting vehicle is oil.

23. The lubricant composition as claimed in claim 18 wherein said supporting vehicle is a grease.

24. A lubricant composition for use in threaded connections, said composition comprising:

20 to 40% by weight of pure crystalline graphite, 0.1 to 10% by weight (calculated on graphite) of an ionizable or polarizable organic phosphate additive, and the balance being a supporting vehicle.

25. The lubricant composition as claimed in claim 24 wherein said supporting vehicle is a grease.

26. The lubricant composition as claimed in claim 24 wherein said supporting vehicle is an oil.

* * * * *